United States Patent [19]

Horsewell et al.

[11] 4,219,033

[45] Aug. 26, 1980

[54] TOBACCO-SMOKE FILTERS

[75] Inventors: Henry G. Horsewell, Totton; John D. Green; John A. Luke, both of Romsey, all of England; Stanley M. Candlish, Lachine, Canada

[73] Assignee: British-American Tobacco Company Limited, London, England

[21] Appl. No.: 839,297

[22] Filed: Oct. 4, 1977

[30] Foreign Application Priority Data

Oct. 6, 1976 [GB] United Kingdom ..... 41533/76

[51] Int. Cl.[2] ..... A24C 5/50; A24D 1/02

[52] U.S. Cl. ..... 131/261 B; 131/10 A; 131/261 A

[58] Field of Search ..... 131/10.3, 10.7, 10.5, 131/10 A, 10.9, 261 R, 261 A, 261 B, 198 R, 264, 198 A, 210, 200, 268, 190, 216, 202, 187; 93/1 C, 77 FT

[56] References Cited

U.S. PATENT DOCUMENTS

| | | | |
|---|---|---|---|
| 1,630,243 | 5/1927 | Rosan | 131/198 A |
| 3,164,157 | 1/1965 | Lebert | 131/10.3 |
| 3,335,729 | 8/1967 | Ice | 131/10.5 |
| 3,394,707 | 7/1968 | Ellis | 131/10.5 |
| 3,496,945 | 2/1970 | Tomkin | 131/10.5 |
| 3,759,268 | 9/1973 | Plourde | 131/198 A |
| 4,049,005 | 9/1977 | Hermandez | 131/187 |

*Primary Examiner*—V. Millin

*Attorney, Agent, or Firm*—Kane, Dalsimer, Kane, Sullivan & Kurucz

[57] ABSTRACT

A tobacco-smoke filter comprises a plug of filter material of which a transverse cross section is impervious to the passage of smoke except for a minor proportion of the area of that cross section which forms a smoke-accelerating orifice, the plug being enclosed by an envelope permitting ingress of air into a region of the plug downstream of the orifice. The cross section may be impervious because of the presence of a barrier diaphragm of impervious material. Thus an annular groove may be provided in the plug at the cross section and may be filled with, or have its walls coated with, an impervious material. Alternatively the cross section may be impervious by reason of the closure of interstices in the filter material by the local application of heat thereto.

8 Claims, 6 Drawing Figures

5·0
4·5
4·0
3·5
3·0
2·5
2·0
1·5
1·0
0·5
D
f
e
1 2 3 4 5 6 7 8 9 10 11 12
N 20
15
10
5
pd
e'
a'
1 2 3 4 5 6 7 8 9 10 11 12
N

TOBACCO-SMOKE FILTERS

This invention concerns tobacco-smoke filters, particularly but not exclusively cigarette filters. It seeks to provide such filters having both good filtration efficiency for total particulate matter and an acceptable pressure drop. It seeks especially to achieve this result over the whole puff range of a cigarette, for instance.

In a cigarette filter comprising a plug of fibrous material, it is known to provide a disc of smoke-impervious material, a plastics material for example, having a smoke-accelerating orifice formed therein. Also known is a filter plug which is compacted to different degrees of density to provide portions of different porosity along the length of the plug. The differential porosity of the latter plug can be produced by heat-treating one or both ends of the plug.

According to the present invention, a tobacco-smoke filter comprises a plug of filter material of which a transverse cross section is impervious to the passage of smoke except for a minor proportion of the area of that cross section which forms a smoke-accelerating orifice, the said plug being enclosed by an envelope permitting the ingress of air into a region of the plug downstream of the orifice. The said cross section may be impervious by reason of the provision of a barrier diaphragm or layer of sealing material filling or coating an annular groove in the plug. Alternatively or additionally the said cross section may be impervious by reason of the closure of interstices in the filter material, for instance interstices between cellulose-acetate fibres, by local application of heat thereto, while leaving the minor proportion of the said area thereof smoke pervious. By a minor proportion in this context is meant no more than 30% of the said area and preferably no more than 20%. A single orifice may, for practical purposes, have a diameter within the range of 1 to 3.5 mm. More than one smoke-accelerating orifice may be provided, in which case the diameter of each is advantageously made less than that of a single orifice.

The said cross section may be located intermediately of the length of the plug, the envelope being air pervious downstream of the said cross section and impervious upstream thereof. A said cross section may be located at the smoke-entry end of the plug. In either case, filter material is present in and/or immediately downstream of the orifice, where it is impinged upon by the accelerated smoke under conditions favourable to separation and retention of particulate matter.

Figure 1:
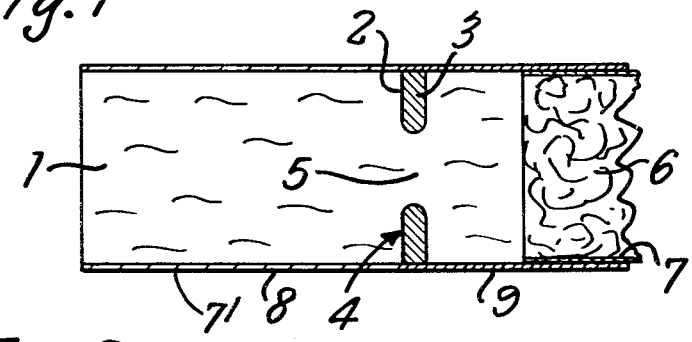
Figure 2:
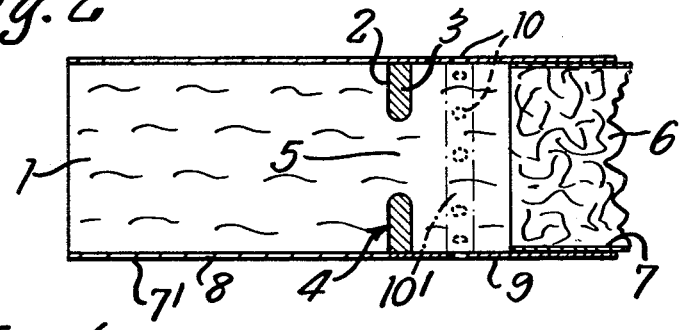
Figure 3:
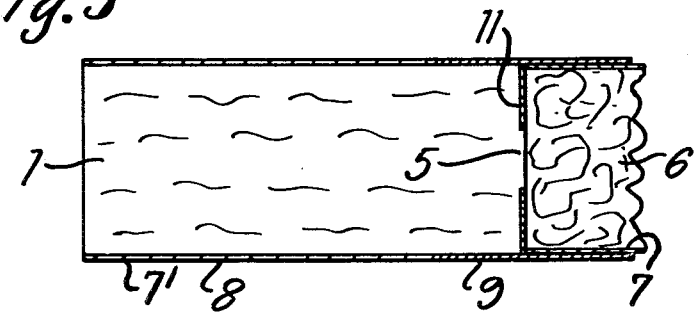
Figure 4:
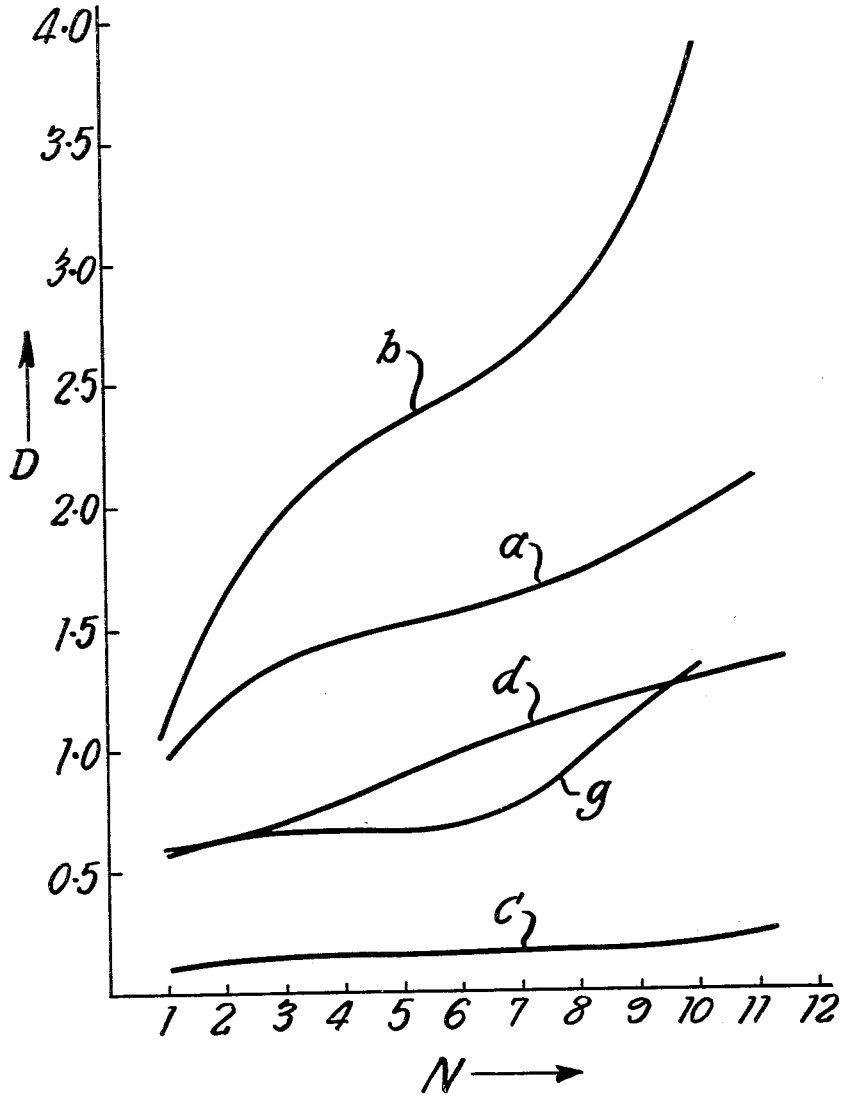
Figure 5:
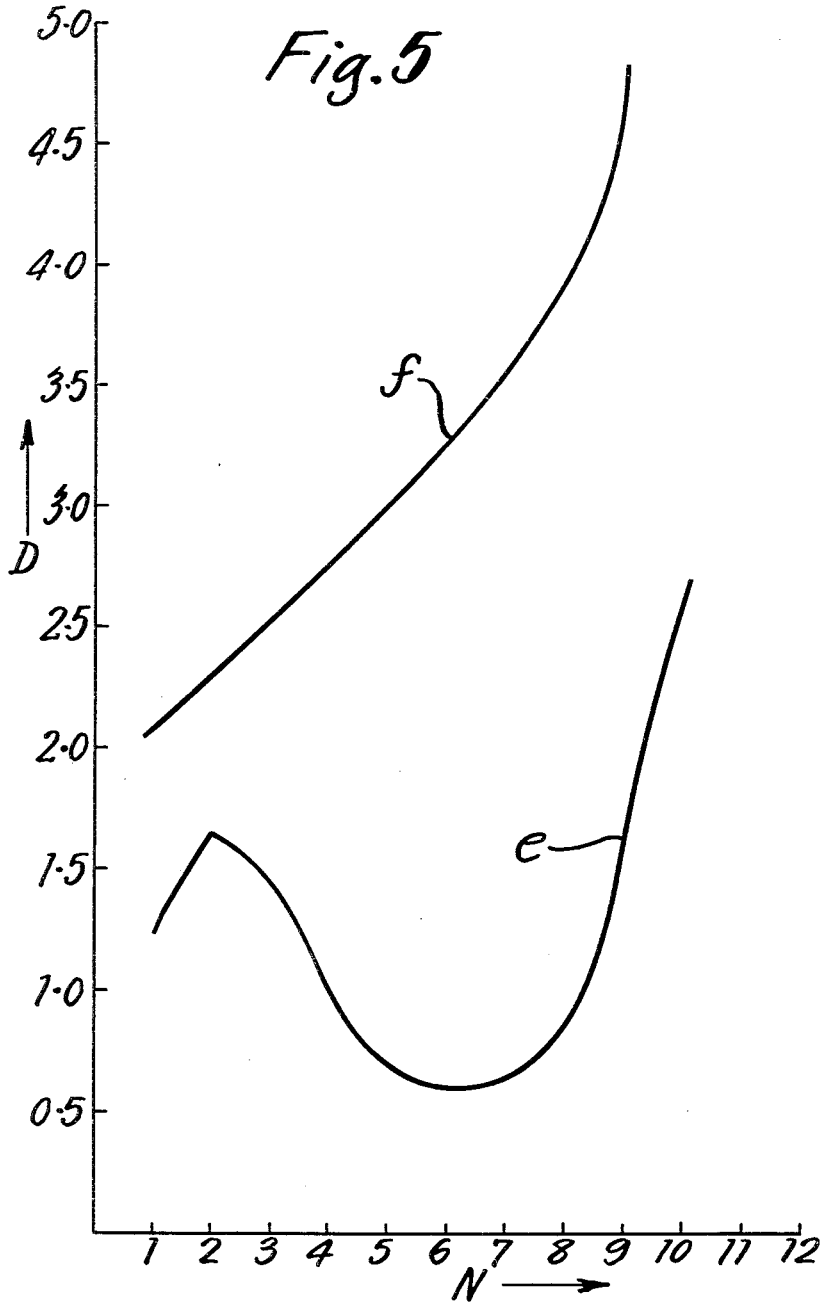
Figure 6:
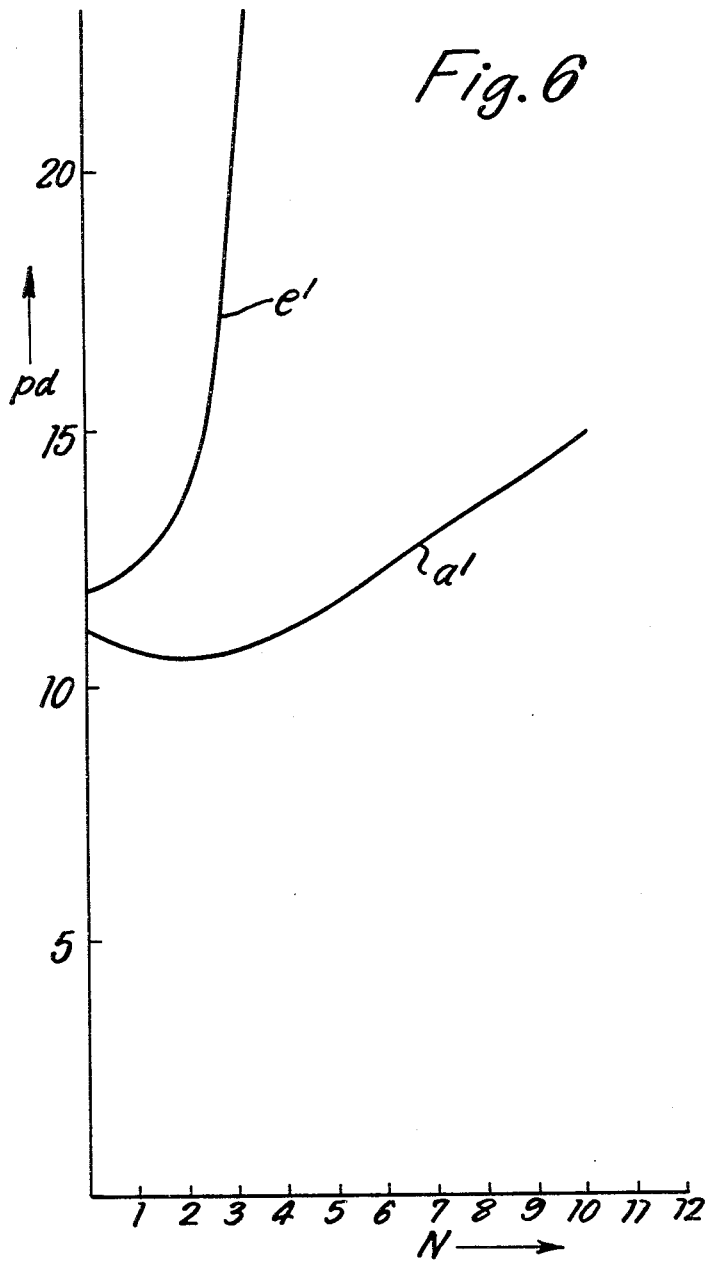

Embodiments of the invention by way of example will now be more fully described with reference to the accompanying drawings, in which:

FIG. 1 is a diagrammatic longitudinal section through one embodiment of filter shown attached to the tobacco rod of a cigarette, FIG. 2 a similar view of a second embodiment, FIG. 3 a similar view of a third embodiment, FIG. 4 a graphical comparison of the filtration performances of the filters of FIGS. 1 to 3 with that of a conventional form of filter, FIG. 5 a graphical representation, also for comparison purposes, of the delivery of total particulate matter by another form of conventional filter and FIG. 6 a graphical comparison of the pressure-drop behaviour of the filter of FIG. 1 with the conventional form of filter whose performance is illustrated by FIG. 5.

The cigarette filter plug 1 of FIG. 1, which is composed of self-bonded (non-wrapped) fibrous cellulose acetate, has, close to but spaced from one end, a deep, substantially parallel-sided, annular groove 2 formed by revolving the plug against a blade which is maintained at a temperature sufficient to melt the cellulose acetate. The base and sides of the groove 2 will thus be glazed by the hot blade and rendered wholly or partially impervious to tobacco smoke. Particularly in the latter case, a sealant material 3, suitably a polyethylene hot-melt adhesive material, is introduced into the groove 2 so as to complete the sealing of the base and sides of the groove. The material may be in a foamed form provided that it is impervious. Slight outward divergence of the sides of the groove will facilitate the deposition of the sealant therein. The sealant may alternatively be applied so as to form a film over the base and sides of the groove 2. In either case, the sealed region forms an annular smoke-impervious barrier diaphram 4 around a central circular neck 5 of smoke-pervious cellulose acetate which forms, in effect, an orifice for the through flow of smoke when the filter is in use.

For use in conjunction with the tobacco rod 6, wrapped in cigarette paper 7, of a cigarette, the plug is enveloped in a tipping $7^1$, of which the portion 8 on the downstream side of the diaphragm 4 is air pervious, whereas the remaining portion 9, which extends over a short length of the cigarette paper 7, is air-impervious. The tipping $7^1$ may be made of non-porous or substantially non-porous material, preferably paper, in which case the portion 8 has been electrostatically or mechanically perforated in known manner to provide a predetermined degree of air-perviousness. The tipping $7^1$ may alternatively be made from a porous paper, in which case, the portion 9 is rendered impervious by treatment with a sealant. For example, it may be coated with a sealant or with an impervious adhesive by which it is adhered to the surface of the plug. To ensure that no part of the smoke stream by-passes the neck 5, the tipping $7^1$ may be adhered to the plug 1 by circumferential beads of adhesive (not shown), one at each margin of the groove 2. Or use could be made of a tipping paper coated with a hot-melt adhesive by which it is adhered to the plug around the circumference.

On smoking a cigarette having a filter such as has been described, the smoke stream entering from the tobacco rod 6 through the full cross section of the plug 1 is constricted and caused to flow through the narrow neck 5 which thus acts as a smoke-accelerating orifice. Immediately contiguous to the neck 5, there are cellulose acetate fibres upon which the accelerated smoke particles will impinge and be collected. On the downstream side of the diaphragm 4, air is drawn in through the tipping $7^1$ and mixes with the smoke. This has the effect of ensuring acceptable draw resistance or pressure drop despite the neck 5, as well as achieving other beneficial effects generally attributed to so-called ventilation.

The puff-by-puff delivery of total particulate matter (T.P.M.) from the filter shown in FIG. 1 with an orifice neck 5 of 2.5 mm diameter 5 mm distant from the tobacco end of a 20 mm long plug 1 was investigated in comparison with a conventional form of filter plug having a similar pressure drop. The conventional plug was identical in form with the plug of FIG. 1 except for the absence of the diaphragm. The results obtained are shown in FIG. 4 in which the delivery D of T.P.M. in mg is plotted against the puff number N over the range of smoking of a cigarette under the standard conditions. Curve a represents the results for the T.P.M. delivery from the filter of FIG. 1 and curve b those for the conventional filter. It will be seen that the former achieves not only a lower overall delivery, that is higher filtration efficiency, but also a more even, sustained, lower delivery of T.P.M. FIG. 4 also illustrates, by the curve c, the puff-by-puff delivery in mg of nicotine with the filter of FIG. 1. An acceptable nicotine delivery which is substantially even over the whole number of puffs is obtained. At the same time, a desirably low ratio of T.P.M. delivery to nicotine delivery can be achieved.

FIG. 2 illustrates a modification of the filter of FIG. 1 in which a ring of small holes 10 is provided in the otherwise impervious portion 9 of the tipping $7^1$ to permit ingress of ventilation air upstream of the diaphragm 4 also. If the said tipping $7^1$ is secured to the plug 1 by adhesive, an adhesive-free band $10^1$ may be left where the ring of holes is located. The curve d in FIG. 4 illustrates the pattern of T.P.M. delivery obtained. The delivery is even lower than that indicated by curve a and is again relatively uniform over the puff range.

Comparative tests were also carried out between a first filter which had a smoke-accelerating orifice neck 5 and was otherwise similar to the filter of FIG. 1 except that the whole length of the plug was wrapped in an impervious wrapping and a second, conventional, form of filter, without orifice neck, whose whole length was also wrapped in an impervious wrapping.

In FIG. 5, the T.P.M. delivery for the first of these filters is shown by curve e and that for the second by curve f. As will be seen, the first filter, having the orifice neck 5, gave an overall lower delivery of T.P.M., but the delivery on a puff-by-puff basis was much more uneven than in the case of curves a and d in FIG. 4. After puff 6, the delivery of T.P.M. rises sharply, which is undesirable and likely to be unacceptable to the smoker.

Comparative tests with respect to filter pressure drop were carried out for the filter of FIG. 1 and the first of the filters just discussed, which differed only by having an impervious wrapping over its whole length. The results are shown in FIG. 6, in which pressure drop pd in cm Water Gauge is plotted against puff number N, curve $a^1$ representing the pressure drop pattern for the filter of FIG. 1 and curve $e^1$ that for the filter with the impervious wrapping. Curve $a^1$ indicates a pressure drop which remains acceptable over the whole puff range, whereas curve $e^1$ indicates a pressure drop which increases so rapidly as to be quite unacceptable after even a few puffs.

The plug of FIG. 3 differs from that of FIG. 1 in that a smoke-accelerating orifice 5 is provided at the upstream end of the cellulose-acetate plug 1 instead of at an intermediate point in its length. The orifice 5 is formed by rendering impervious the whole end surface 11 of the plug except for a small central portion, suitably of 1.5 mm diameter, which is left as the pervious neck extending towards the tobacco rod 6. The end surface 11 may be rendered impervious by embossing and glazing it by means of a die provided with a central hole whose internal diameter is equal to that of the orifice 5. The die, heated to a temperature suitable for glazing the cellulose acetate, is moved axially of the plug to press its end surface against the surface 11 of the plug.

The T.P.M. delivery of the filter shown in FIG. 3 is represented by the curve g in FIG. 4. The delivery is low and acceptably even over the puff range.

A plug similar to that of FIG. 3 may be obtained by using a die which is similar to that just referred to, but lacks the central hole, so that the whole of the end surface of the plug is smoke-imperviously glazed. The smoke-accelerating orifice is then formed by piercing the glazed end with a pin. The pin may be heated to a temperature such that local fusing of the cellulose acetate fibres is caused. Alternatively, use may be made of a die with a flat glazing face from which a spike extends. The end of the plug is smoke-imperviously glazed except for the opening formed by the spike.

Finally, a plug similar to that of FIG. 3 may be produced by coating the plug with a sealant material over its whole surface except for a small central portion which provides the smoke-accelerating orifice.

In a plug otherwise similar to that of FIG. 3, the glazed or sealed end surface, instead of being flat, may be curved, for example dished as viewed in a longitudinal section of the plug. The surface may be that of a recess extending inwardly from the end of the plug.

In any of the filters of FIGS. 1 to 3, ventilation downstream of the neck 5 could be obtained by providing a ring or rings of holes, such for example as the holes 10 of the filter of FIG. 2, in the portion 8 of the tipping $7^1$.

In a filter, there may be more than one smoke-accelerating orifice in a diaphragm. Thus, a diaphragm may be provided with more than one unglazed or uncoated portion in an otherwise glazed or coated surface. Also, in a filter there may be more than one diaphragm, each with a smoke-accelerating orifice, spaced apart along the filter so that the orifices act in series.

The smoke-accelerating orifice may be disposed at or near the end of the plug remote from the tobacco rod. However, higher filtration efficiences are obtainable when the orifice is located at or near the tobacco end of the plug.

The choice of filter material for the plug 1 is not restricted to fibrous materials such as cellulose acetate. Bonded granular filter materials, for example carbon, may be employed. Also the filter plug may be composed of a mixture of materials, for example, a mixture of polypropylene fibres and cellulose-acetate fibres or a mixture of cellulose-acetate fibres and carbon granules.

The invention can be applied in conjunction with plugs of non-bonded filter material. In this case, the wrapping material or materials selected must satisfy the requirements of the present invention as well as serving the purpose of effectively containing the unbonded material.

We claim:

1. A tobacco-smoke filter comprising a plug produced from smoke-pervious fibrous filter material, which material is rendered impervious to the passage of smoke over a transverse cross section of the plug except for a proportion of that cross section of a cross sectional area, not less than 0.8 $mm^2$, which forms a smoke-accelerating orifice having a perviousness for tobacco smoke which is at least equal to that of the unmodified perviousness of the fibrous material of the plug, and the plug being enclosed by an envelope having means for ingress of air into the plug fibrous material downstream of the orifice.

2. A filter according to claim 1, wherein the cross section is impervious by reason of the presence of a barrier diaphragm of smoke-impervious material.

3. A filter according to claim 1 wherein an annular groove is provided in the plug at the cross section and has an application within it of a smoke-impervious material.

4. A filter according to claim 1, wherein interstices in the filter material are closed in the cross section by the local application of heat to the material, while leaving the minor proportion of the area smoke pervious.

5. A filter according to claim 1, wherein the cross section is located intermediately of the length of the plug, and the envelope being air pervious downstream of the cross section.

6. A filter according to claim 1, wherein the envelope is air-impervious upstream of the cross section.

7. A filter according to claim 1, wherein the envelope is provided with ventilation holes upstream of the cross section.

8. A filter according to claim 1, wherein the cross section is located at the smoke-entry end of the plug.

* * * * *